United States Patent [19]

Carrington et al.

[11] Patent Number: 4,827,912

[45] Date of Patent: May 9, 1989

[54] MULTI-CHAMBER PORTING DEVICE

[75] Inventors: Michael R. Carrington, Northbrook; Jack L. Harms, Mundelein, both of Ill.

[73] Assignee: The Kendall Company, Boston, Mass.

[21] Appl. No.: 98,268

[22] Filed: Sep. 18, 1987

[51] Int. Cl.[4] ..... A61H 1/00

[52] U.S. Cl. ..... 128/24 R; 128/64

[58] Field of Search ..... 441/90, 40, 41; 128/64, 128/24 R, 60, DIG. 20, 30, 39, 48, 327

[56] References Cited

U.S. PATENT DOCUMENTS

| | | | |
|---|---|---|---|
| 1,764,838 | 6/1930 | Horne | 128/64 |
| 2,531,074 | 11/1950 | Miller | 128/38 |
| 2,533,504 | 12/1950 | Poor | 128/24 R |
| 2,543,284 | 2/1951 | Gleason | 128/64 |
| 2,579,209 | 12/1951 | Smith | 128/64 |
| 2,781,041 | 2/1957 | Weinberg | 128/66 |
| 2,833,275 | 5/1958 | Tannicliffe | 128/64 |
| 3,826,249 | 7/1974 | Lee et al. | 128/24 R |
| 4,231,355 | 11/1980 | Hara | 128/64 |
| 4,374,518 | 2/1983 | Villaneuva | 128/64 |
| 4,402,312 | 9/1983 | Villari et al. | 128/64 |

FOREIGN PATENT DOCUMENTS

| | | | |
|---|---|---|---|
| 276620 | 11/1969 | Austria | 128/64 |

*Primary Examiner*—Edgar S. Burr
*Assistant Examiner*—Lane E. Hardwicke
*Attorney, Agent, or Firm*—Donald N. Halgren

[57] ABSTRACT

An extended port arrangement for a multi-chambered sequential compression sleeve where a port extends through an outer large pressure chamber and in communication with an inner pressure chamber. The extended port consists of an inner bushing sealable with the sheet defining the inner chamber. The port has a housing which extends through an outer sheet and mates with the inner bushing and is in fluid communication therewith.

4 Claims, 1 Drawing Sheet

MULTI-CHAMBER PORTING DEVICE

Field of the Invention

This invention relates to therapeutic and prophylactic compressive devices, and more particularly to port arrangements for supplying pressure to sleeves for applying pressure against a patient's limb.

Prior Art

Blood flow in a patient's extremities, particularly the legs, markedly decreases during confinement of the patient. Such pooling or stasis of blood is particularly pronounced during surgery, immediately after surgery, and when the patient has been confined to bed for extended periods of time. Stasis of blood is a significant cause of the formation of thrombi in the patient's extremities, which may have a serious deleterious effect on the patient, including death. In certain patients, it is desirable to move fluid out of interstitial places in extremity tissues, in order to reduce swelling associated with edema in the extremities.

Compressive devices, shown, for example, in U.S. Pat. Nos. 4,013,069 to Hasty and 4,030,488 also to Hasty, incorporated herein by reference, develop and apply the desired compressive pressure against the patient's limbs. Such devices comprise a pair of sleeves as shown in U.S. Pat. No. 4,156,425 to Arkans wherein a plurality of successive compressed chambers are arranged in the sleeve.

U.S. Pat. No. 4,320,746, also to Arkans, shows how connecting ports are adapted to supply the compressive fluid to the series of chambers in a sleeve.

Sleeves, however, are being developed such as shown in commonly assigned U.S. patent application Ser. No. 07/098252 entitled "Multi-layered Sequential Compression Sleeve" and incorporated herein by reference, that have multiple layers of chambers, and as such, require special port assemblies to permit a first chamber layer to be inflated separate and apart from a radially adjacent layer of chambers.

It is thus an object of the present invention to provide a port assembly which permits easy assembly of a sleeve and which also permits ready inflatability of radially separate compressive chambers.

BRIEF SUMMARY OF THE INVENTION

The present invention comprises a porting device for multi-layered sequential compression sleeves.

An elongated pressure sleeve encloses a patient's limb, the sleeve having a plurality of laterally extending separate fluid pressure chambers progressively arranged longitudinally along the sleeve from a lower portion of the limb proximal to the patient's heart relative to the lower portion.

The sleeve also has a large fluid chamber disposed radially adjacent the plurality of laterally extending separate fluid pressure chambers. The port for supplying the inner plurality of fluid pressure chambers (inner when the sleeve is wrapped around a patient' limb) extends through the single large fluid pressure chamber.

The sleeve thus has an innermost fluid impervious sheet comprising the inner side of the plurality of laterally extending separate fluid pressure chambers. The sleeve also comprises an outermost fluid impervious sheet comprising the outer side of the large fluid pressure chamber. An intermediate sheet divides the sleeve, into the plurality of compartments on the inner half, and the large single compartment in the outer half. The intermediate sheet is sealed to the innermost sheet at particular margins as described in the aforementioned commonly assigned patent application, so as to define the plurality of chambers with the innermost sheet. The outermost sheet may have a seal margin near its common periphery with the intermediate sheet, to define the large fluid pressure chamber therebetween.

An arrangement of extended ports are disposed through the outermost sheet and the large fluid pressure chamber, and are in fluid communication, one with each pair of commonly pressurizable plurality of laterally extending separate fluid pressure chambers. Standard ports are in fluid communication with the large single outermost chamber through the outermost sheet.

Each extended port comprises a bushing which has a flange which is sealed to the intermediate fluid impervious sheet. An outer housing has a flange which is sealed to the outermost fluid impervious sheet. The outer housing has an inner tubular member which mates with the bushing attached to the intermediate sheet and disposed between the intermediate and outermost sheets. The outer housing has another tubular member extending outwardly from its flange. The outer tubular member is fluidly communicable with supply conduits from a controller or sequential intermittent pressure generator or the like.

The inner tubular member is matable with the bushing, which acts as a spacer between the intermediate and outermost fluid impervious sheets, so as to not interfere with the large fluid pressure chambers yet supply each of the plurality of fluid pressure chambers with their respective pressurized fluid charges.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
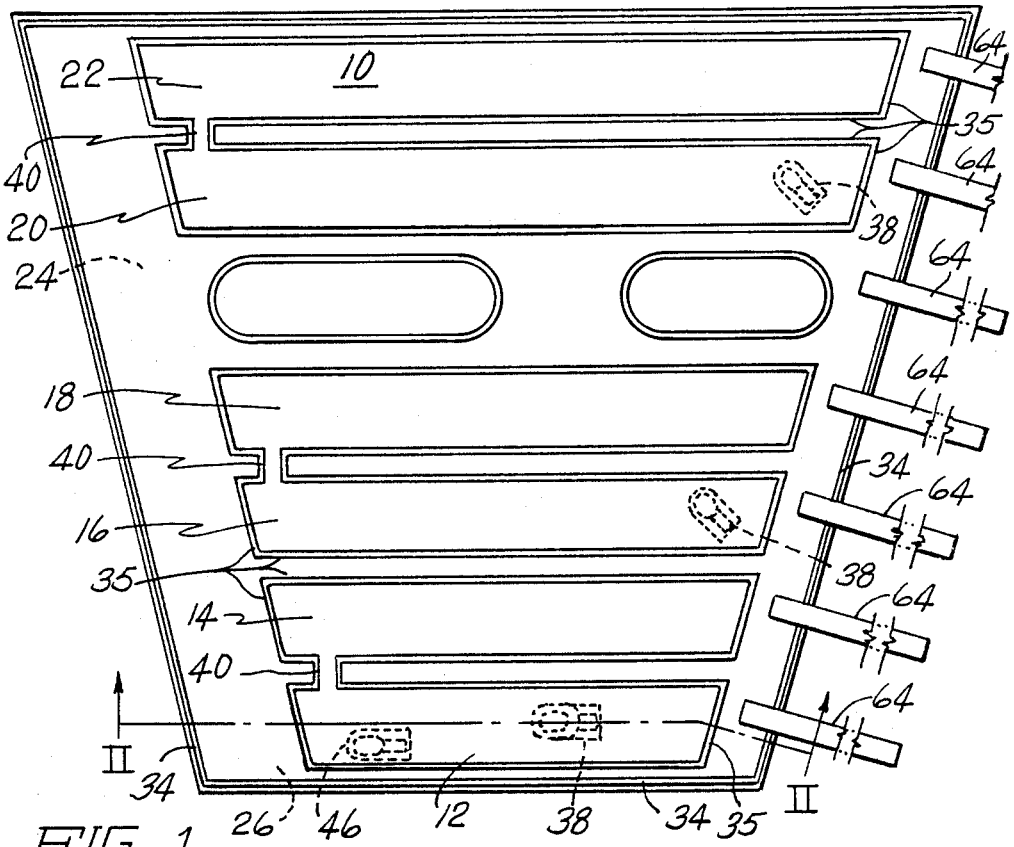
FIG. 1 is a plan view of the innermost side of a sleeve constructed according to the principles of the present invention.

Referring to the drawings in detail, and particularly to FIG. 1, there is shown an elongated multi-layered sequential compression sleeve 10.

Figure 2:
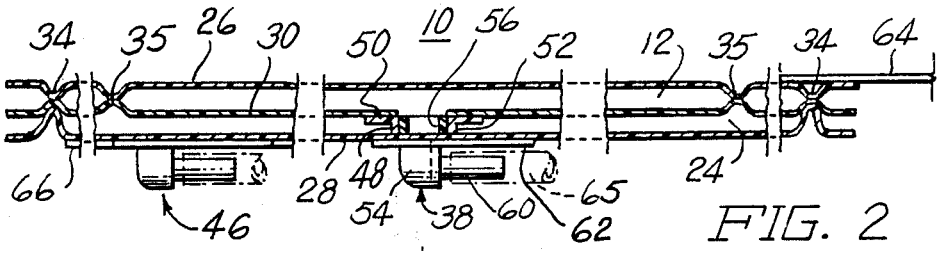
FIG. 2 is a view taken along the lines II—II of FIG. 1.

The elongated sleeve 10, utilized to circumferentially enclose a patient's limb, has a plurality of laterally extending separate fluid pressure chambers 12, 14 16, 18, 20 and 22. The elongated sleeve 10 also has a large fluid pressure chamber 24, disposed radially adjacent the plurality of laterally extending separate fluid pressure chambers 12, 14, 16, 18, 20 and 22, as best seen in FIG. 2.

The elongated sleeve 10 has an innermost fluid impervious sheet 26 comprising the inner side of the plurality of laterally extending separate fluid pressure chambers 12, 14, 16, 18, 20 and 22. The sleeve 10 also has an outermost fluid impervious sheet 28 comprising the outer side of the large fluid pressure chamber 24. An intermediate sheet 30, divides the elongated sleeve 10, into the plurality of chambers 12, 14, 16, 18, 20 and 22 on the inner half side thereof, and the large single fluid pressure chamber 24 on the outer half thereof. The innermost, intermediate and outermost fluid impervious sheets 26, 30 and 28 are all heat sealed at their margins 34 near common peripheral edges, as shown in FIGS. 1 and 2. The innermost and intermediate fluid impervious sheets 26 and 30 are sealed to one another at transversely extending generally rectangularly shaped margins 35, to define the smaller separate fluid pressure chambers 12, 14, 16, 18, 20 and 22, respectively. The outermost sheet 28 and the intermediate sheet 30 define, within their heat sealed peripheral margins 34, the large single chamber 24.

An arrangement of extended ports 38 are disposed through the outermost sheet 28 and the large fluid pressure chamber 24, and are in fluid communication, one each, with the plurality of laterally extending separate fluid pressure chambers 12, 16 and 20. The fluid pressure chambers 12 and 14, are in fluid communication with one another, by a channel 40, as are fluid pressure chambers 16 and 18, as well as fluid pressure chambers 20 and 22.

Standard pressure communication ports 46, such as those shown in the aforementioned U.S. Pat. No. 4,320,746, and incorporated herein by reference, are in communication with the large single fluid pressure chamber 24 through the outermost fluid impervious sheet 28.

Figure 3:
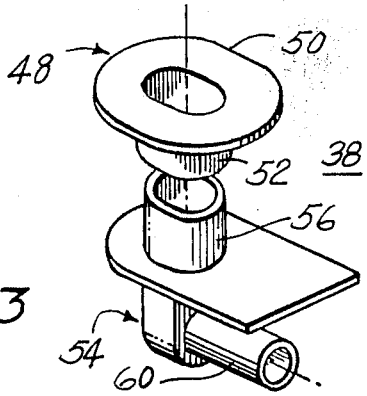
FIG. 3 is an exploded perspective view of an extended port of the present invention.

Each extended port 38, as shown in FIGS. 2 and 3, comprises a bushing 48 which has a flange 50 which is attachable by heat sealing, adhesive or the like, to the intermediate sheet 30. The bushing 48 consists of a cylindrical housing 52 which is attached to the flange 50, and in communication therethrough. The extended port 38 also comprises an outer housing 54 having an inner tubular member 56 of generally cylindrical shape, and of a smaller diameter, so as to be able to mate with the housing of the bushing 48.

The outer housing 54 has an outer tubular member 60 extending away from a flange 62 at the base of the outer housing 54. The outer tubular member 60 is in fluid communication with pressurized fluid supply conduits 65, as shown in FIG. 2, which conduits extend from a controller or sequential compression generator, as shown in the aforementioned U.S. Pat. No. 4,013,069.

The inner tubular member 56 is matable with the bushing 48, the cylindrical housing 52 of which acts as a spacer, as shown in FIG. 2, between the intermediate fluid impervious sheet 30 an the outermost fluid impervious sheet 28, so as not to interfere with the fluid pressure supplied to the large fluid pressure chamber 24, yet be able to supply its respective longitudinally extending (innermost) fluid pressure chambers 12, 14, 16, 18, 20 and 22 with pressurized fluid on an intermittent basis, even as the large fluid pressure chamber 24, is maintained at a constant fluid pressure from the controller.

An arrangement of attachment means such as strips of gripping material 64, marketed under the Trademark VELCRO, are disposed on one edge of the Sleeve 10. They may attach to receiving strips 66 on the opposite edge of the Sleeve 10, as shown in FIG. 2.

Thus, there has been shown a unique port arrangement which permits pressurized fluid to reach an inner chamber, through an existing pressure chamber, without interference therewith. The port permits ease of assembly and the adaptation of all the ports on the outer side of the sleeve 10, permitting a greater comfort and higher safety for the patient on whose limb, the sleeve 10 is wrapped.

We claim:

1. An extended port arrangement for providing pressurized fluid from a pressurized fluid source to a pressurizable chamber disposed laterally adjacent an outer pressurizable chamber, of an inflatable limb-wrapable sleeve having an innermost, an outermost, and an intermediate fluid impervious sheet, comprising:

an inner port means attached to said intermediate impervious sheet and in fluid communication with said inner chamber;

an outer port means attached to said outermost sheet of said outer chamber; and connection means disposed in the inner side of said outer port means, to register with said inner port means, to provide fluid connection through said outer chamber;

wherein said inner port means comprises a bushing having a flange for permitting sealing said inner port means to said intermediate sheet, said intermediate sheet partially defining the innermost chamber, said bushing having a housing attached to said flange for providing intermating receipt of said connection means of said outer port.

2. An extended port arrangement as recited in claim 1 wherein said intermediate fluid impervious sheet is disposed between said innermost sheet and said outer sheet, all of said sheets joined at margins adjacent their common periphery;

said inner port means comprising a bushing which is in communication through said intermediate sheet;

said outer port means being lockable with said inner port means to provide secure fluid communication therethrough.

3. An extended port arrangement is recited in claim 1, wherein said outer port means has a centrally disposed flange for permitting sealing of said outer port means to the outermost sheet, said outermost sheet partially defining the outermost chamber.

4. An extended port arrangement for providing pressurized fluid from a pressurized fluid source to a pressurized chamber disposed laterally adjacent an outer pressurizable chamber, an inflatable limb-wrapable sleeve having an innermost, an outermost, and an intermediate fluid impervious sheet, comprising:

an inner port means attached to said intermediate impervious sheet and in fluid communication with said inner chamber;

an outer port means attached to said outermost sheet of said outer chamber; and connection means disposed in the inner side of said outer port means, to register with said inner port means, to provide fluid connection through said outer chamber;

wherein said inner port means comprises a bushing having a flange for permitting sealing said inner port means to said intermediate sheet, said intermediate sheet partially defining the innermost chamber, said bushing having a housing attached to said flange for providing intermating receipt of said connection means of said outer port means;

said housing being arranged so as to snugly receive said connection means without leakage of pressurized fluid therefrom.

* * * * *